United States Patent [19]

Almqvist et al.

[11] 4,434,643

[45] Mar. 6, 1984

[54] METHOD AND A DEVICE FOR EMBOSSING HEAT EXCHANGER PLATES

[75] Inventors: Christer Almqvist, Täby; Lars Lindahl, Handen, both of Sweden

[73] Assignee: ReHeat AB, Taby, Sweden

[21] Appl. No.: 336,315

[22] Filed: Dec. 31, 1981

Related U.S. Application Data

[63] Continuation of Ser. No. 90,495, Nov. 1, 1979, abandoned.

[30] Foreign Application Priority Data

Nov. 8, 1978 [SE] Sweden ..... 7811539

[51] Int. Cl.[3] ..... B21D 53/02

[52] U.S. Cl. ..... 72/379; 72/382; 72/385; 72/414; 72/465; 29/157.3 R

[58] Field of Search ..... 72/307, 379, 382, 385, 72/412–415, 466, 470, 475, 465; 29/157.3 R

[56] References Cited

U.S. PATENT DOCUMENTS

| | | | |
|---|---|---|---|
| 2,359,650 | 10/1944 | Kelleher | 72/414 |
| 2,413,179 | 12/1946 | Grandmont et al. | 72/414 |
| 2,421,457 | 6/1947 | Lindsay | 72/414 |
| 2,438,837 | 3/1948 | Archer et al. | 72/465 |
| 2,948,325 | 8/1960 | Welindt | 72/415 |
| 3,307,387 | 3/1967 | Lacey, Jr. et al. | 72/379 |
| 3,319,452 | 5/1967 | Rethwish et al. | 72/466 |
| 3,748,889 | 7/1973 | Miller et al. | 72/385 |
| 3,762,206 | 10/1973 | Wright et al. | 72/382 |
| 3,824,664 | 7/1974 | Seeff | 72/379 |
| 3,892,119 | 7/1975 | Miller et al. | 72/385 |
| 4,022,050 | 5/1977 | Davis et al. | 72/379 |

FOREIGN PATENT DOCUMENTS

| | | |
|---|---|---|
| 343699 | 6/1978 | Austria . |
| 1452636 | 4/1969 | Fed. Rep. of Germany . |
| 2109346 | 10/1971 | Fed. Rep. of Germany . |
| 321492 | 3/1970 | Sweden . |

*Primary Examiner*—Daniel C. Crane

*Attorney, Agent, or Firm*—Cushman, Darby & Cushman

[57] ABSTRACT

The invention relates to a method of embossing heat exchanger plates in several steps by a pressing tool, in that after a portion of the sheet blank has been embossed a subsequent portion of the blank is embossed, after this has been positioned and fixed in place between the punch and the die of the press. The positioning and clamping takes place in such a manner that a groove with zigzag extension pressed at the preceding embossing step in the sheet is caused to engage between a groove and, respectively, a bead arranged in the punch and the die which prior to the embossing are moved against each other and inside of the plane of the punch and, respectively, die by spring force.

3 Claims, 4 Drawing Figures

METHOD AND A DEVICE FOR EMBOSSING HEAT EXCHANGER PLATES

Figure 1:
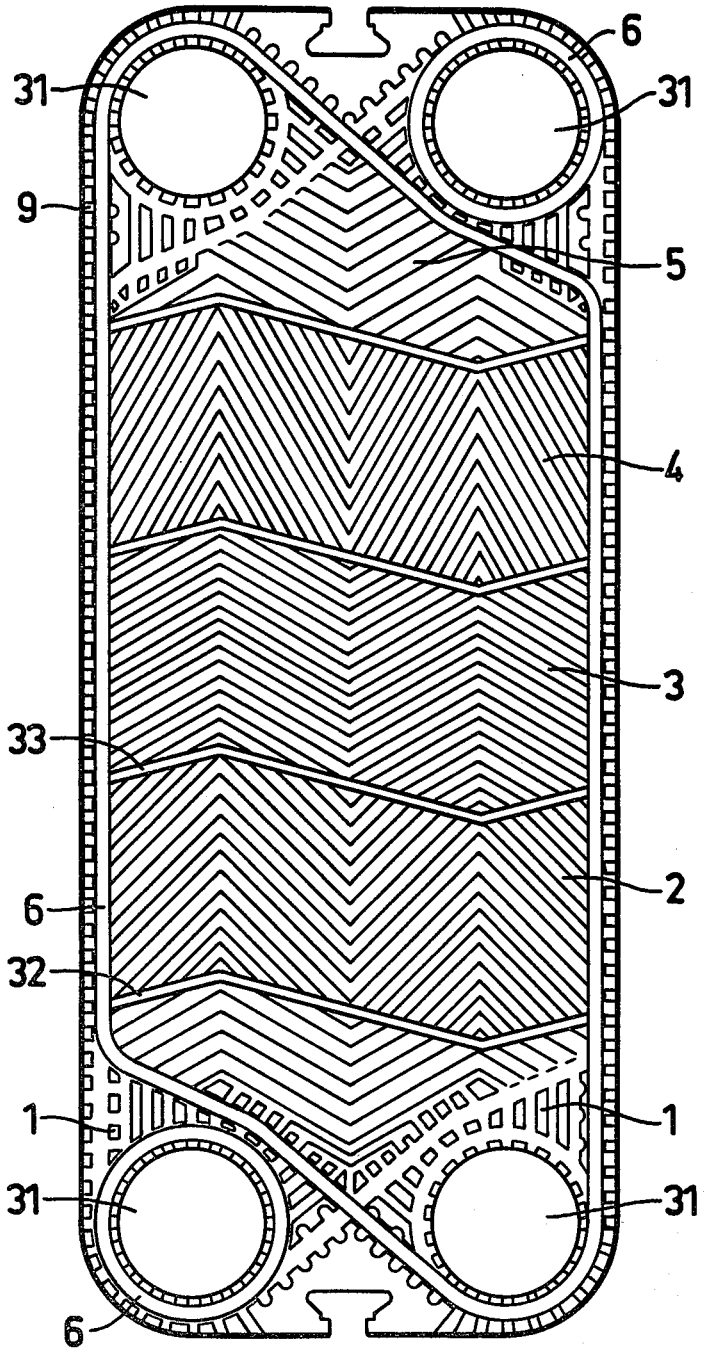

This is a continuation of application Ser. No. 90,495 filed Nov. 1, 1979, now abandoned.

This invention relates to a method and a device for embossing heat exchanger plates for plate heat exchangers of the kind comprising a plurality of adjacent parallel heat exchanger plates, which are clamped in a stand and have edge packings on the heat exchanger plates so arranged, that sealed passages for two heat exchanging media are formed.

Pressing tools for the deep drawing of heat exchanger plates are very expensive and thereby restrict the manufacturer's assortment. It is known to design that part of the pressing tool which includes the heat surface of the heat exchanger plate exchangeable, while the more complicated parts of the tool for forming the packing grooves of the plates and the areas about the through bores are in common for different kinds of plates See. SE-PS No. 321 492. As the cleaning out ridges of the heat surface differ as to number, location, extension or direction relative to a definite line in the plane of the plates, heat exchanger plates with different thermal length are obtained. A combination of plates with different thermal lengths renders it possible to solve a certain heat exchanger function more accurately. As parts of the pressing tool are in common for different kinds of plates, the pressing tool costs are reduced. This tool design is intended to press the heat exchanger plate in a single step.

In addition to the desire of reducing the pressing tool costs at an increased plate assortment, i.e. at heat exchanger plates with different thermal lengths, there is also a demand of manufacturing larger heat exchanger plates, with heat surfaces exceeding 1 $m^2$ per plate. The presses required at conventional manufacture of larger heat exchanger plates, i.e. pressing the plate in a single step, must have a very large press platen and high press forces, 6000 tons or more, and consequently are very expensive. Owing to the high investment cost in a high-pressure press, the manufacture of a larger heat exchanger plate is profitable first at a relatively very large manufacturing volume. Besides, the requirement of parallelism in press platens is high, because the embossing depths over the entire heat exchanger plate must be kept within small deviations, because these deviations in embossing depth add up with the number of heat exchanger plates clamped in the stand between parallel end walls. A deviation in embossing depth of 0.1 mm results for a plate package of 400 heat exchanger plates in a total dimension difference of 40 mm between the end walls of the stand. The parallelity requirement thus increases with increasing press size.

In order to manufacture larger heat exchanger plates without increasing the already high capital cost for a high-pressure press of a normal required size, it is proposed according to the invention, which has been given the characterizing features defined in the attached claims, that the pressing of every heat exhanger plate is carried out in a number of complete partial steps. Hereby the necessary press force and platen area of the high-pressure press can be reduced substantially. The necessary press force in practice is restricted to the press force necessary for embossing an inlet and outlet portion on the heat exchanger plate, and the largest measure of the press platen depends on the width of the heat exchanger plate and not on its length, which normally is twice as great. By embossing on a smaller press platen, furthermore, the dificulties are avoided which prevail at larger platen areas, viz. to obtain satisfactory parallelity between upper and lower press platens.

Embossing of the heat exchanger plate carried out in steps renders it possible to obtain a great number of plate combinations at substantially lower tool costs than by conventional pressing. The tools for embossing the more complicated end portions about the ports of the heat exchanger plate are in common, but the simpler and cheaper tool parts for embossing the heat surface of the heat exhanger plate can be designed with different patterns. By selecting different patterns in the heat surface, the thermal properties of the heat exchanger plate can be affected. The heat surface can be embossed in a number of steps, and each step may have different patterns. By combining patterns in the different pressing steps of the heat surface, different thermal properties of the heat exchanger plate can be obtained.

It is also possible by a different number of pressing steps in the heat surface to obtain different lengths, i.e. different surface sizes of the heat exchanger plates. For every surface size on the heat exhanger plate, however, a special stand size and differnt edge packings are required.

Figure 2:
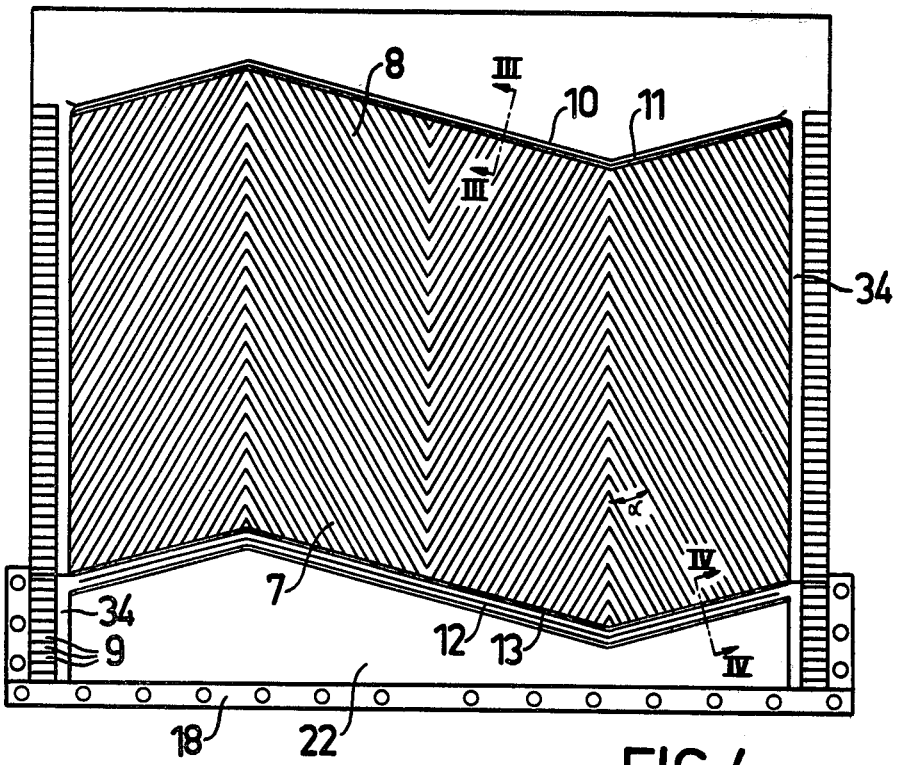
Figure 3:
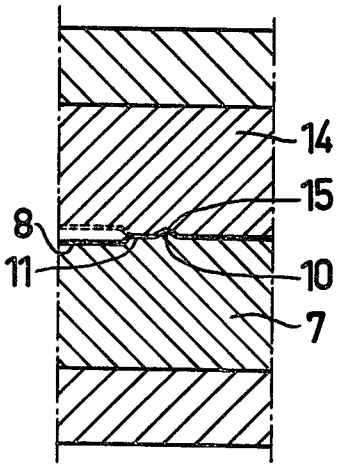
Figure 4:
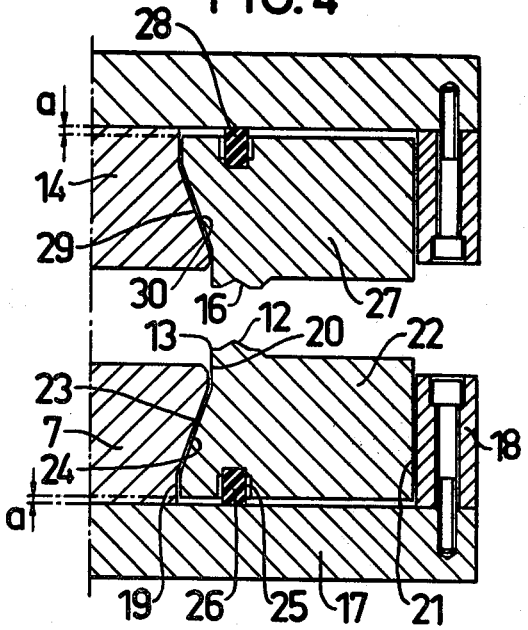

The invention is described in greater detail in the following by way of an embodiment, and with reference to the accompanying drawings, in which FIG. 1 shows a heat exchanger plate manufactured according to the present invention, FIG. 2 shows the die of the pressing tool for the heat surface, seen from above, FIG. 3 is a partial section III—III in FIG. 2 with punch, FIG. 4 is a partial section IV—IV in FIG. 2 with punch.

FIG. 1 shows a heat exchanger plate manufactured according to the invention in five steps. In step 1 the end portion 1 with through bore 31 is made, in steps 2–4 the heat surfaces 2,3,4 are made, and in step 5 the second end portion 5 also with through bore 31 is made. The end portions in principle are identical, while the intermediate heat surfaces 2–4 may be equal or have, for example, different rise of the corrugation. 6 designates the packing carried by the plate in packing grooves embossed therein.

It should be understood clearly that the total press force at the embossing carried out in steps (1–5) is reduced to the corresponding area of the pressing tool, in the present case to about one fifth of what would be required if the plate according to usual standards would be pressed in a single step. According to the invention the platen area of the high-pressure press is decreased substantially, in that the size of the press platen is determined by the dimension of the pressing tool plus the space for fixing the tool in the press platen. In the above example the platen area of the press will be only about one fifth of the area required for single-step pressing.

FIG. 2 shows the die 7 of a tool for embossing a heat surface, i.e. one of the steps 2–4, seen from above. The pattern constituting the heat surface is designated by 8 and consists of wave-shaped corrugation, which in a manner usual in the art in this case is divided into four fields with changing corrugation directions, thereby forming with each other angles, so-called rise angles. The die 7 is provided with the pattern for embossing the packing grooves 34 and the distance members 9, which are located outside the heat surface proper and also have the form of corrugations. The pattern 8 constituting the heat surface is defined at one end by an elevation 10 in the die. Said elevation has the cross-sectional shape of a V turned upside down and extends in zigzag form. Between the elevation 10 and the corrugation 8 a plane neutral portion 11 (see also FIG. 3) is located in the neutral plane of the pressed sheet. It is hereby prevented that the sheet at the subsequent pressing is subjected to subsequent deformation in the groove formed, which is important because the sheet is cold-hardened at the deformation in the preceding pressing step.

The pattern 8 is defined at the other end by a strip or bead 12, which will be described later, and which has the same cross-sectional shape and extension as the elevation 10. Also between this bead 12 and the corrugation 8 there is a plane neutral portion 13.

The pressing tool punch cooperating with the die is provided in usual manner with a pattern corresponding to the die. In FIGS. 3 and 4 also the punch 14 partially is shown. The elevation 10 and bead 12 are corresponded in the punch by a notch 15 and, respectively, a groove 16.

The die 7 is carried by a support plate 17, on which a guide 18 is screwed, see FIG. 4. Between the guide 18 and the die 7, which is provided with edges 19 and 20 in parallel with one side 21 of the guide, an intermediate space is located, in which a jaw 22 is provided which extends across the entire die. The jaw 22 is formed on its upper surface with said bead 12, as clearly appears from FIG. 4. The jaw is guided movably in vertical direction between one side 21 of the guide 18 and the guide edges 19 and 20 of the die 7. Owing to the edges 19 and 20 being offset in parallel relative to each other, an inclined stop 23 is formed between them which together with the stop 24 of the jaw 22 defines the upward movement thereof. The jaw 22 is provided on its lower surface with a groove 25, in which a spring member in the form of a rubber strip 26 is provided. Said spring member forces the jaw 22 resiliently upward so that the top of the bead 12 is the distance "a" above the support plate 17.

The punch 14 is provided in a corresponding manner with a jaw 27 guided at the punch and formed with the groove 16. The jaw 27 is actuated by a spring member 28 and restricted in its movement by the stop surfaces 29,30 in the same manner as applying to the jaw 22. In a state sprung out the groove 16 corresponding to the bead 12 is offset the distance "a" below the neutral plane for the punch. The jaws 27 and 22 with their edges facing toward the die and, respectively, punch follow the zigzag extension of the bead and groove. The rubber strip 26 and 28 can extend along the entire jaw or be divided into several smaller portions distributed in a suitable way along the length of the jaw.

When a heat exchanger plate is to be embossed according to the invention, first the end portion 1 (FIG. 1) together with the groove 32 is embossed in the sheet blank. Thereafter the first heat surface 2 with the groove 33 is embossed either in another press with already mounted die and punch or in the same press after the tools have been exchanged against those intended for the heat surface. The sheet blank with the already embossed end portion 1 is placed on the die (for example 7) so that the downwardly open groove 32 of the sheet is located on the bead 12 of the jaw 22 sprung out. When the punch 14 is being lowered for embossing the sheet, first the groove 16 of the jaw 27 also sprung out is lowered over the ridge of the sheet formed by the groove. The sheet is hereby finely adjusted automatically on the die and fixed for the continued embossing operation, in that the jaws during the continued lowering movement of the punch are pressed against each other, with the sheet between themselves and against the action of the spring members 26 and 28.

When the heat surface 2 has been embossed, the sheet is moved, if the same heat surface pattern is to be embossed, so that the groove 33 pressed at the preceding operation is placed over the bead 12, as described above, and the procedure is repeated.

When the last heat surface of the plate has been completed, the other end portion 5 is embossed in the same manner. The heat exchanger plate thereafter is complete.

The aforesaid procedure is only of illustrative nature and refers to a single plate. When a series of similar plates, but with different patterns of the heat surfaces in the respective plate are to be manufactured, these plates, of course, are embossed in the way most economical for the manufacture, for example by completing every step in all plates before changing the tools.

It is possible within the scope of the invention to vary the device described. The groove, for example, may have another cross-sectional shape and another extension than those shown. The groove, for example, may be more "short-waved" or have an extension corresponding to the pattern of the heat surface.

What we claim is:

1. A method of producing a heat exchanger plate of the kind having opposite end portions each having apertures therethrough for passage of heat exchanger fluids, the plate also having at least one intermediate portion between the end portions, the intermediate portion and each end portion having a gasket-receiving groove along each edge extending longitudinally of the plate, said method comprising: pressing the whole of each portion simultaneously between parts of a pressing tool and pressing each portion sequentially with respect to other portions, the step of pressing the intermediate portion including simultaneously pressing (a) a non-linear aligning groove extending generally traversely of the plate at one end of said intermediate portion to provide for linear and transverse alignment of the plate during a subsequent pressing operation, (b) a plurality of parallel non-linear corrugations over the remainder of the longitudinal dimension of said intermediate portion with said non-linear corrugations having a different pattern than said non-linear aligning groove and (c) a first gasket-receiving groove extending longitudinally along each edge of said intermediate portion; and thereafter moving the plate blank longitudinally of itself relative to the pressing tool, adjusting the position of the plate blank relative to the parts of the pressing tool by fitting said non-linear aligning groove in the blank to a complementary contour of the pressing tool thereby aligning the plate blank linearly and transversely relative to the pressing tool; and pressing another portion of the heat exchanger plate with the pressing tool thereby providing a second gasket-receiving groove extending longitudinally along each edge of said intermediate portion connecting with said first gasket-receiving groove.

2. A method as in claim 1 wherein the aligning groove has a zig-zag shape.

3. A method as in claim 1 wherein the corrugations are pressed with tools of different patterns.

* * * * *